US009308639B2

(12) United States Patent
Chen et al.

(10) Patent No.: US 9,308,639 B2
(45) Date of Patent: Apr. 12, 2016

(54) TOOL STORAGE DEVICE

(71) Applicants: Chang-Xun Chen, Changhua County (TW); Yu-Lun Chen, Changhua County (TW)

(72) Inventors: Chang-Xun Chen, Changhua County (TW); Yu-Lun Chen, Changhua County (TW)

( * ) Notice: Subject to any disclaimer, the term of this patent is extended or adjusted under 35 U.S.C. 154(b) by 39 days.

(21) Appl. No.: 14/327,648

(22) Filed: Jul. 10, 2014

(65) Prior Publication Data

US 2015/0096911 A1 Apr. 9, 2015

(30) Foreign Application Priority Data

Oct. 3, 2013 (TW) ..... 102135855 A

(51) Int. Cl.
*B65D 85/20* (2006.01)
*B25H 3/00* (2006.01)
*B25H 3/02* (2006.01)

(52) U.S. Cl.
CPC . *B25H 3/023* (2013.01); *B25H 3/02* (2013.01)

(58) Field of Classification Search
CPC ..... B25H 3/003; B25H 3/025; B25H 3/06
USPC ..... 206/207, 205, 572, 230, 234, 372–379
See application file for complete search history.

(56) References Cited

U.S. PATENT DOCUMENTS 7,168,559 B2 * 1/2007 Chen ..... B25H 3/003 206/373
8,186,510 B1 * 5/2012 Chen ..... B25H 3/003 206/373
8,302,771 B2 * 11/2012 Arslan ..... B25H 3/003 206/372
8,469,190 B1 * 6/2013 Chang ..... B25H 3/003 206/372
8,899,417 B1 * 12/2014 Chen ..... B25H 3/003 206/372

* cited by examiner

*Primary Examiner* — Chun Cheung
(74) *Attorney, Agent, or Firm* — Trop, Pruner & Hu, P.C.

(57) ABSTRACT

A tool storage device includes a housing, a linkage unit, a biasing member and a locking member. The linkage unit includes a driving member, multiple storing members, and a linkage mechanism interconnecting the storing members and the driving member. The linkage unit is convertible between a retracted position, where the storing members are accommodated in the housing, and an opening position, where the storing members are driven by the driving member via the linkage mechanism to pivot so that ends of the storing members are away from the housing with different orientations. The biasing member biases the linkage unit toward the expanded position. The locking member is disposed for locking releasably the linkage unit in the retracted position.

8 Claims, 5 Drawing Sheets

TOOL STORAGE DEVICE

CROSS-REFERENCE TO RELATED APPLICATION

This application claims priority of Taiwanese Patent Application No. 102135855, filed on Oct. 3, 2013.

BACKGROUND OF THE INVENTION

1. Field of the Invention

The invention relates to a tool storage device, more particularly to a tool storage device with a linkage mechanism.

2. Description of the Related Art

In order to conveniently store and retrieve multiple tools or multiple tool heads of a tool, conventional tool storage devices are provided, such as those disclosed in Taiwanese Patents TW475509, TWM371068, TW582328, TWM241196, TWM241197, TWM389004, TW20137093 and TWM392723.

There are a variety of structures and operational methods for each of the aforementioned Patent cases. As an example, TW475509 and TWM371068 disclose conventional tool storage devices having the same limitation, which is the usage of a slide cap or lift cap that can be slid or lifted open. Storing members for tool heads are biased by springs to stand up so as to facilitate access of the tool heads.

Moreover, in Taiwanese Patents TW582328, TWM241196, TWM241197, TWM389004 and TW20137093, other conventional tool storage devices are disclosed in which the storing members and the caps are associated with a linkage mechanism, so that movement of the caps will simultaneously move the tool heads upright. In addition, in TWM392723, the user has to manually rotate a gear for driving each of the storing members to standup from a flat-lying position (i.e., from the horizontal position to the vertical position).

However, the abovementioned conventional tool storage devices still have a number of drawbacks to be overcome.

First, the movement range of each of the storing members is too small for the tools therein to be easily picked up by the user. The storing members are in parallel arrangement. Each of the storing members is pivotable about a longitudinal axis thereof. As such, the storing members are laid out to be disposed proximate to one another, and the user would not be able to pick up a tool head from a storing member without interference from neighboring tool heads or storing members.

Second, the opening and closing operations of the caps are not convenient and are time-consuming. Great force may be required to slide or lift the cap open.

SUMMARY OF THE INVENTION

Therefore, the object of the present invention is to provide a tool storage device that can alleviate the aforesaid drawbacks of the prior art.

According to the pre sent invention, there is provided a tool storage device including a housing, a linkage unit, a biasing member and a locking member. The housing is formed with an accommodating space, and a plurality of side openings. Each of the openings is formed in an outer lateral side of the housing and is in spatial communication with the accommodating space. The linkage unit is disposed in the housing and includes a driving member, a plurality of storing members and a linkage mechanism. The storing members surround the driving member, and each has a first end that is proximate to the driving member and that is pivotally connected to the housing, and a second end that is distal from the first end. The linkage mechanism interconnects the storing members and the driving member. The linkage unit is convertible between a retracted position, where the second ends of the storing members are accommodated in the accommodating space, and an expanded position, where the storing members are driven by the driving member via the linkage mechanism to pivot so that the second ends of the storing members are away from the housing with different orientations via the side openings, respectively. The biasing member is disposed in the housing for biasing the linkage unit from the retracted position to the expanded position. The locking member is mounted to the housing for locking releasably the linkage unit in the retracted position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
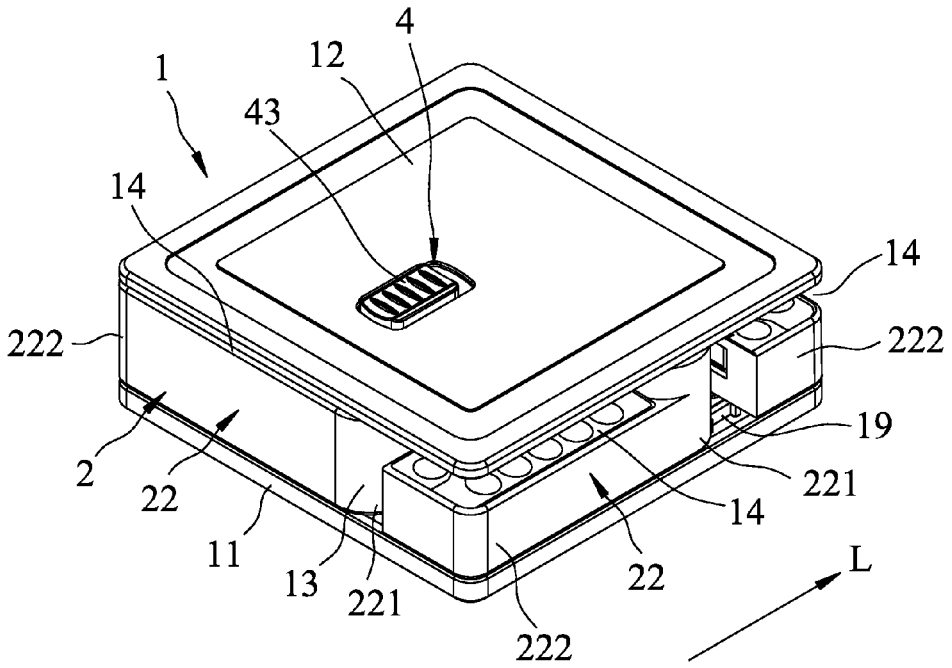
FIG. 1 is an assembled perspective view of a preferred embodiment of a tool storage device according to the present invention.
Figure 2:
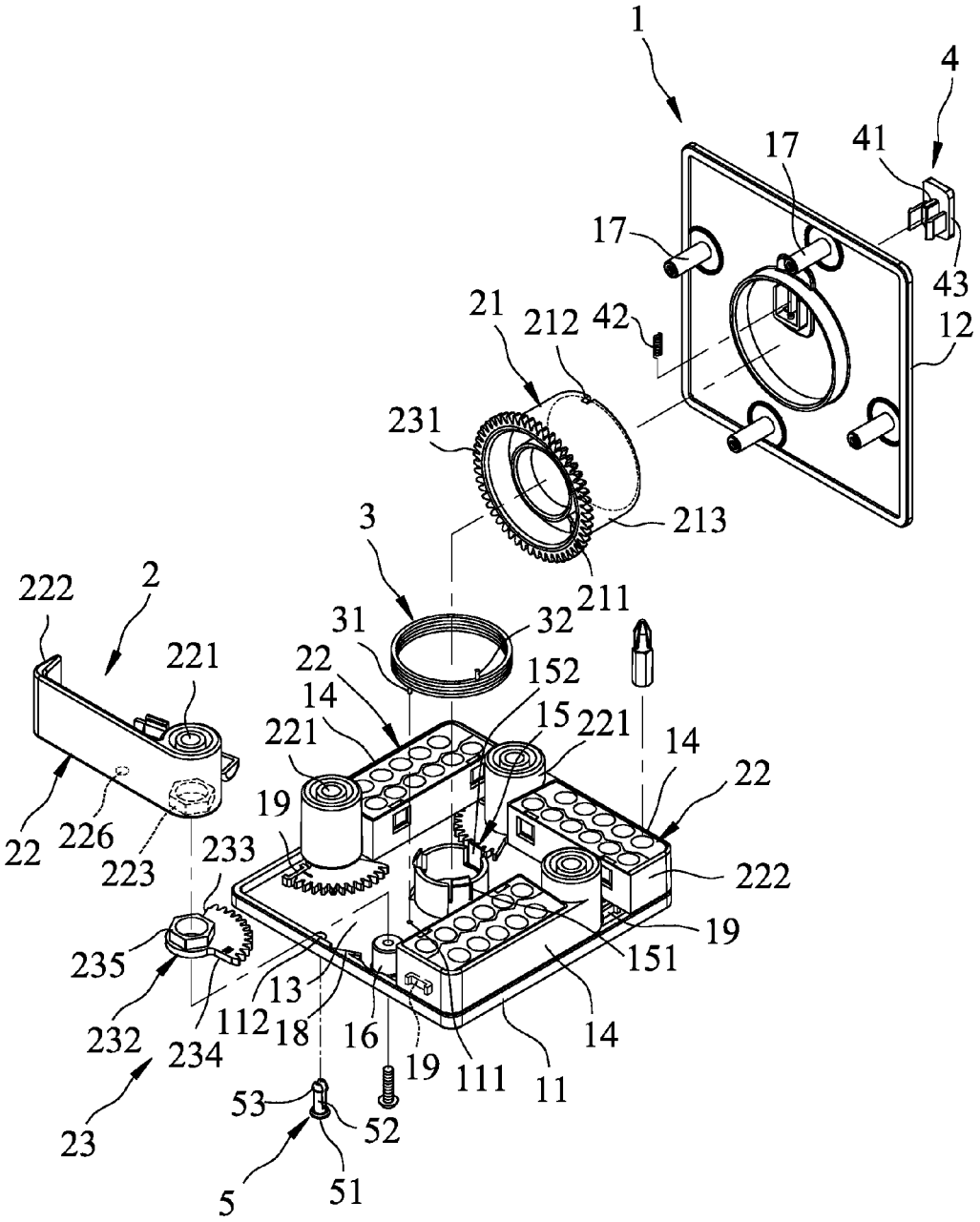
FIG. 2 is a partly exploded perspective view of the preferred embodiment.

Referring to FIGS. 1 and 2, a preferred embodiment of a tool storage device according to the present invention includes a housing 1, a linkage unit 2, a biasing member 3 and a locking member 4.

The housing 1 includes a bottom body 11, and a top body 12 opposite to the bottom body 11. The housing 1 is formed with an accommodating space 13 which is cooperatively defined by the bottom and top bodies 11, 12, and a plurality of side openings 14 formed between the bottom and top bodies 11, 12. In this embodiment, each of the side openings 14 is formed in a respective one of outer lateral sides of the housing 1 and is in spatial communication with the accommodating space 13.

The housing 1 also includes a main column 15, a plurality of bottom columns 16 (only one is visible in FIG. 2) and a plurality of top columns 17. The main column 15 is mounted on a center of the bottom body 11. The bottom columns 16 are mounted on the bottom body 11 and surround the main column 15. The top columns 17 are mounted on the top body 12 and are registered respectively with the bottom columns 16.

The linkage unit 2 is disposed in the housing 1, and includes a driving member 21, a plurality of storing members 22 and a linkage mechanism 23. The driving member 21 is mounted in the housing 1, and has an annular wall 213 that is sleeved rotatably on the main column 15 and that is formed with a slot 212. The main column 15 is formed with a plurality of slits 151, and a plurality of securing hooks 152 at a top end thereof for fixing the driving member 21 between the bottom body 11 and the securing hooks 152. Each of the securing hooks 152 is formed between an adjacent pair of the slits 151 so that the securing hooks 152 are resiliently deformable to facilitate the coupling of the driving member 21 to the main column 15. The storing members 22 surround the driving member 21. Each of the storing members 22 has a first end 221 that is proximate to the driving member 21 and that is pivotally sleeved on a respective one of the top columns 17 and a corresponding one of the bottom columns 16, and a second end 222 that is distal from the first end 221.

In this embodiment, the driving member 21 of the linkage unit 2 is rotatable about a central axis thereof, and each of the storing members 22 is pivotable about a pivot axis which is parallel to the central axis of the driving member 21.

Figure 5:
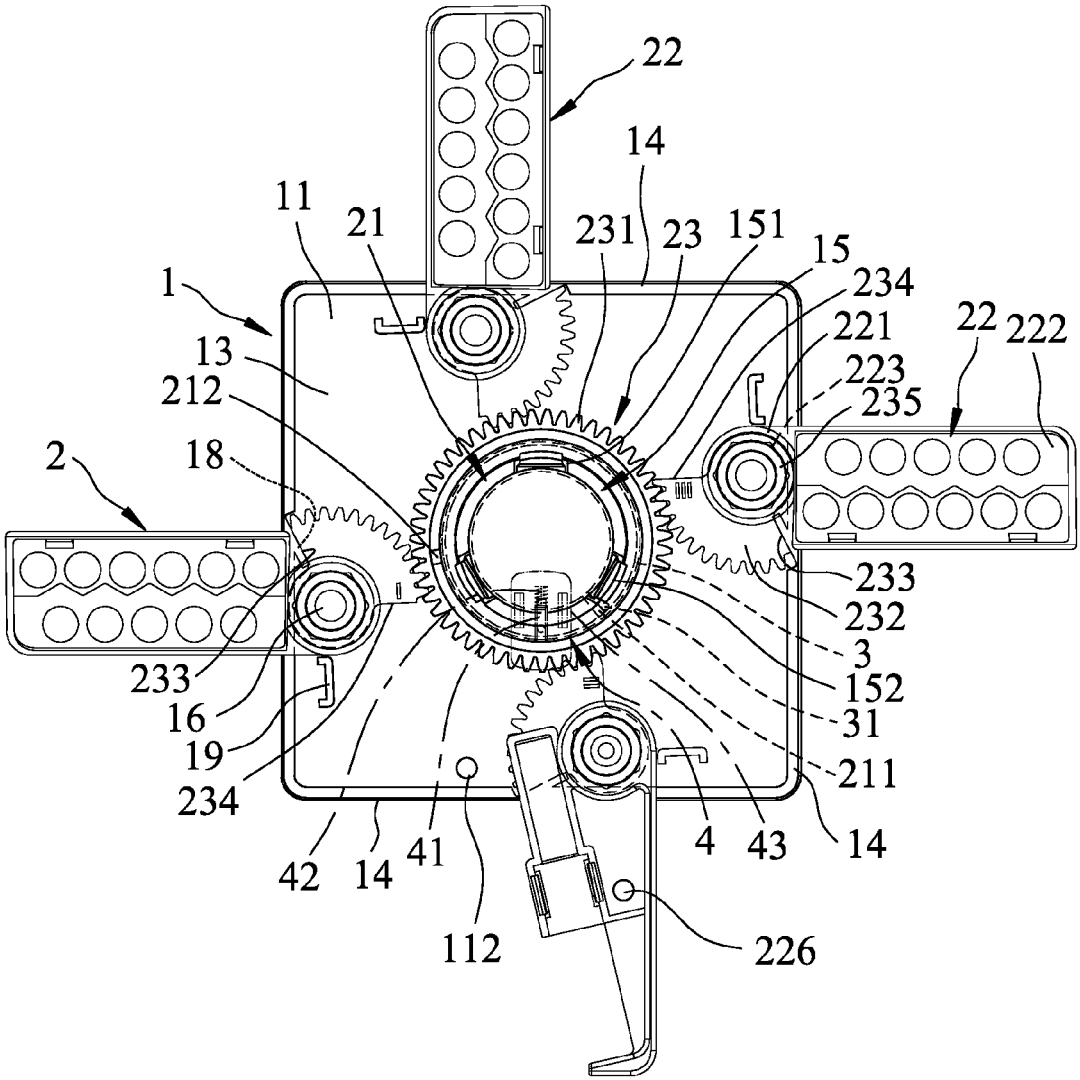
FIG. 5 is another top view of the preferred embodiment without the top body and with the linkage unit in an expanded position.

The linkage unit 2 is convertible between a retracted position (see FIG. 3), where the second ends 222 of the storing members 22 are accommodated in the accommodating space 13, and an expanded position (see FIG. 5), where the storing members 22 are driven by the driving member 21 via the linkage mechanism 23 to pivot so that the second ends 222 of the storing members 22 are away from the housing 1 with different orientations (i.e. the storing members 22 extend from the housing 1 indifferent directions).

In this embodiment, the linkage mechanism 23 interconnects the storing members 22 and the driving member 21, and includes a sun gear 231 and a plurality of planet gears 232. The sun gear 231 is mounted on the driving member 21. Each of the planet gears 232 is connected to the first end 221 of a respective one of the storing members 22, and meshes with the sun gear 231. Each of the planet gears 232 is substantially fan-shaped, and has first and second edges 233, 234. Further referring to FIGS. 3 and 5, the housing 1 further includes a plurality of open stoppers 18 and a plurality of close stoppers 19. Each of the open stoppers 18 abuts against the first edge 233 of a respective one of the planet gears 232 when the linkage unit 2 is in the expanded position, and each of the close stoppers 19 abuts against the second edge 234 of a respective one of the planet gears 232 when the linkage unit 2 is in the retracted position. Each of the storing members 22 further has a non-circular nut hole 223 at the first end 221. The linkage mechanism 23 further includes a plurality of non-circular nuts 235, each of which engages fittingly the nut hole 223 of a respective one of the storing members 22 so that each of the storing members 22 is co-rotatable with the respective one of the planet gears 232.

When the linkage unit 2 is in the retracted position, the storing members 22 are entirely accommodated in the accommodating space 13. During conversion of the linkage unit 2 from the retracted position to the expanded position, the driving member 21 is rotated to drive rotation of the planet gears 232 via the sun gear 231 of the linkage mechanism 23, thereby causing pivot movement of the storing members 22 outward from the housing 1 respectively through the side openings 14.

The biasing member 3 is disposed in the housing 1 for biasing the linkage unit 2 from the retracted position to the expanded position. In this embodiment, the biasing member 3 is a torsion spring for biasing the storing members 22 away from the retracted position. The bottom body 11 of the housing 1 is formed with an insert hole 111, and the driving member 21 of the linkage unit 2 further has a stopper plate 211 (see FIG. 2) connected to an inner surface of the annular wall 213. The biasing member 3 has one end 31 inserted into the insert hole 111, and an opposite end 32 abutting against the stopper plate 211.

The locking member 4 is mounted on the top body 12 of the housing 1 for locking releasably the linkage unit 2 in the retracted position. The locking member 4 includes a locking bolt 41, a return spring 42 and a release button 43. The locking bolt 41 is movable along an axis (L) (see FIG. 1) and is removably inserted into the slot 212 of the driving member 21 when the linkage unit 2 is in the retracted position for locking the driving member 21. The return spring 42 biases the locking bolt 41 along the axis (L). The release button 43 is connected to the locking bolt 41 and is exposed from the top body 12.

To switch the linkage unit 2 from the retracted position to the expanded position, the release button 43 is pushed against a resilient force of the return spring 42 to disengage the locking bolt 41 from the slot 212 of the driving member 21, thereby unlocking the driving member 21. Afterward, a biasing force of the biasing member 3 automatically drives the driving member 21 to rotate via the abutment between the stopper plate 21 and the other end 32 of the biasing member 3 for eventually converting the linkage unit 2 from the retracted position to the expanded position. During the aforesaid conversion of the linkage unit 2, the locking bolt 41 slides on the inner surface of the annular wall 213 of the driving member 21.

Since the storing members 22 have different orientations when the linkage unit 2 is in the expanded position, access to a tool head from any of the storing members 22 would not be easily interfered by a neighboring one of the storing members 22. Moreover, the user can easily conduct the expansion of the storing members 22 by simply pushing the release button 43.

To switch the linkage unit 2 from the expanded position back to the retracted position, the user just needs to push any of the storing members 22 toward the accommodating space 13 in the housing 1. All of the storing members 22 will move simultaneously into the accommodating space 13 by virtue of the linkage between the sun gear 231 and the planet gears 232 of the linkage mechanism 23. Meanwhile, the driving member 21 is driven to rotate reversely until the linkage unit 2 returns to the retracted position, where the slot 212 is registered with the locking bolt 41. The locking bolt 41 of the locking member 4 will then be biased by the return spring 42 to re-engage the slot 212, thereby locking the linkage unit 2 in the retracted position.

Figure 3:
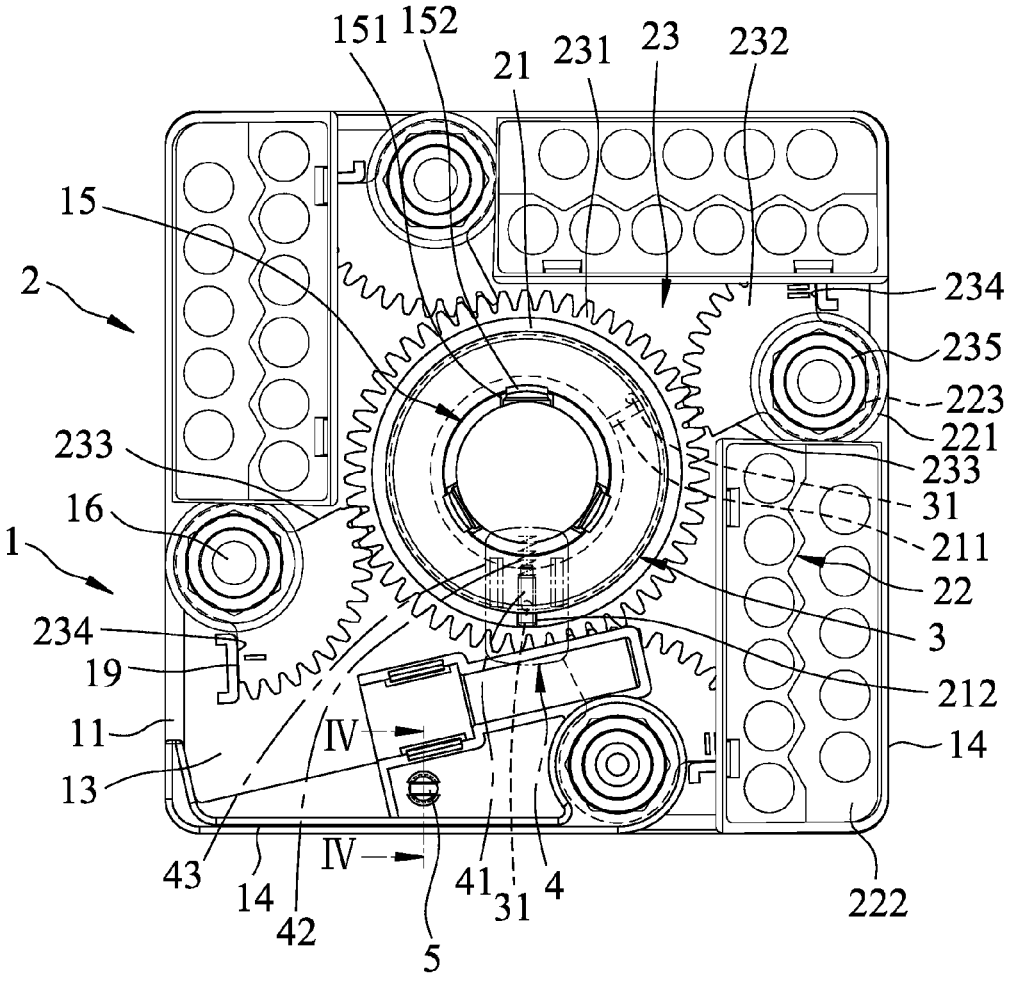
FIG. 3 is a top view of the preferred embodiment without a top body and with a linkage unit in a retracted position.
Figure 4:
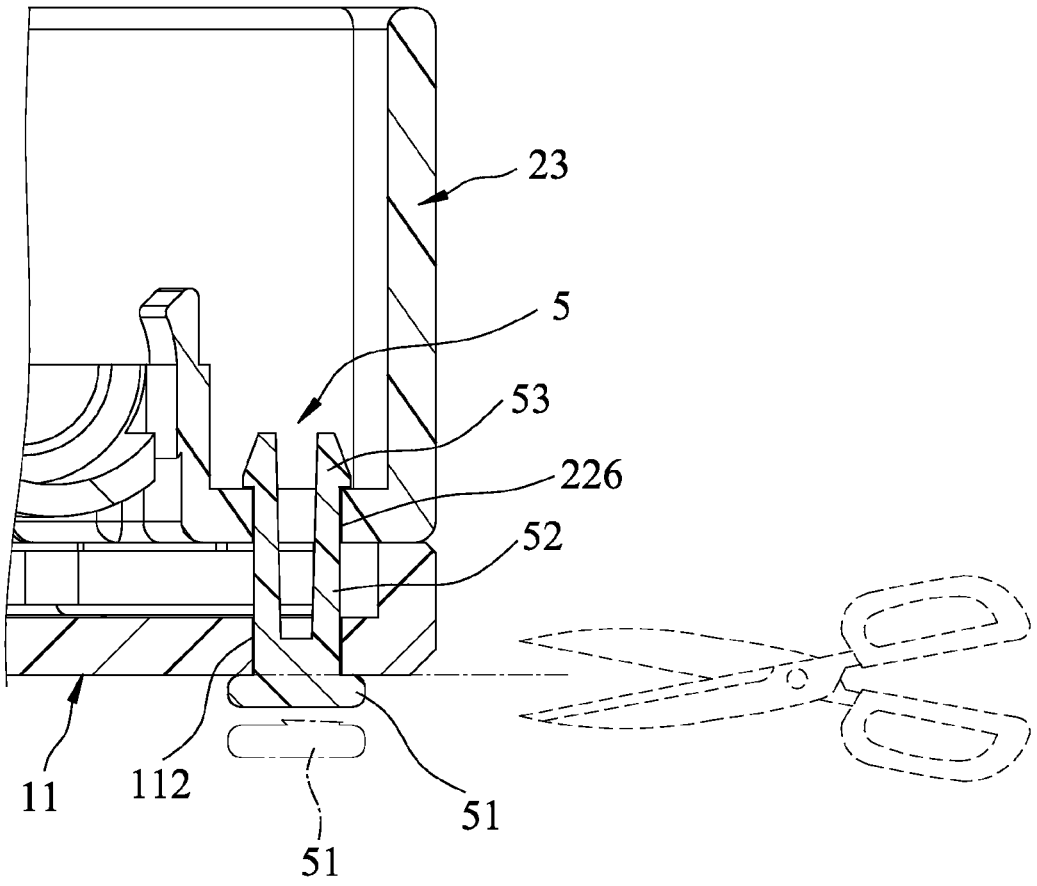
FIG. 4 is an enlarged fragmentary sectional view for illustrating an anti-theft bolt of the preferred embodiment.

With reference to FIGS. 2 to 4, preferably, the tool storage device of this invention further includes a breakable anti-theft bolt 5 for securing the linkage unit 2 in the retracted position. The anti-theft bolt 5 has a head portion 51 that is disposed outside of the bottom body 11 of the housing 1, an insert arm 52 that extends from the head portion 51 through a bolt hole 112 (see FIGS. 4 and 5) formed in the bottom body 11 and an orifice 226 (see FIG. 4) formed in one of the storing members 22, and a hook portion 53 that is connected to a distal end of the insert arm 52 and that engages the one of the storing members 22. The anti-theft bolt 5 can prevent the tool heads which are retained in the storing members 22 from being stolen before purchase of the tool storage device, and will be broken by the user before the tool storage device is used for the first time.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A tool storage device comprising:

a housing formed with an accommodating space, and a plurality of side openings, each of which is formed in an outer lateral side of said housing and is in spatial communication with said accommodating space;

a linkage unit disposed in said housing and including a driving member, a plurality of storing members that surround said driving member, each of said storing members having a first end that is proximate to said driving member and that is pivotally connected to said housing, and a second end that is distal from said first end, and a linkage mechanism that interconnects said storing members and said driving member, said linkage unit being convertible between a retracted position, where said second ends of said storing members are accommodated in said accommodating space, and an expanded position, where said storing members are driven by said driving member via said linkage mechanism to pivot so that said second ends of said storing members are away from said housing with different orientations via the side openings, respectively;

a biasing member disposed in said housing for biasing said linkage unit from the retracted position to the expanded position; and a locking member mounted to said housing for locking releasably said linkage unit in the retracted position;

wherein said housing includes a bottom body, and a top body opposite to said bottom body, said side openings being formed between said bottom and top bodies; and wherein said driving member of said linkage unit is mounted in said housing and is rotatable about a central axis thereof, each of said storing members being pivotable about a pivot axis which is parallel to the central axis of said driving member.

2. The tool storage device as claimed in claim 1, wherein said linkage mechanism of said linkage unit includes a sun gear mounted on said driving member, and a plurality of planet gears, each of which is connected to said first end of a respective one of said storing members and meshes with said sun gear.

3. The tool storage device as claimed in claim 2, wherein each of said planet gears is substantially fan-shaped and has first and second edges, said housing including a plurality of open stoppers and a plurality of close stoppers, each of said open stoppers abutting against said first edge of a respective one of said planet gears when said linkage unit is in the expanded position, each of said close stoppers abutting against said second edge of a respective one of said planet gears when said linkage unit is in the retracted position.

4. The tool storage device as claimed in claim 1, further comprising a breakable anti-theft bolt for securing said linkage unit in the retracted position, said anti-theft bolt having a head portion that is disposed outside of said bottom body of said housing, an insert arm that extends from said head portion through said bottom body and one of said storing members, and a hook portion that is connected to a distal end of said insert arm and that engages said one of said storing members.

5. The tool storage device as claimed in claim 1, wherein said housing further includes a main column mounted on a center of said bottom body, a plurality of bottom columns mounted on said bottom body and surrounding said main column, and a plurality of top columns mounted on said top body and registered respectively with said bottom columns, said main column being formed with a plurality of securing hooks at a top end thereof for fixing said driving member between said bottom body of said housing and said securing hooks, and said first end of each of said storing members being pivotally sleeved on a respective one of said top columns and a corresponding one of said bottom columns.

6. The tool storage device as claimed in claim 1, wherein said biasing member is a torsion spring for biasing said storing members away from the retracted position, and has one end connected to said bottom body and an opposite end connected to said driving member.

7. The tool storage device as claimed in claim 1, wherein:

said driving member of said linkage unit is formed with a slot; and said locking member is mounted on said top body and includes a locking bolt movable along an axis and removably inserted into said slot when said linkage unit is in the retracted position for locking said driving member, a return spring biasing said locking bolt along the axis, and a release button exposed from said top body and operable to disengage said locking bolt from said slot against a resilient force of said return spring so as to unlock said driving member to permit conversion of said linkage unit from the retracted position to the expanded position.

8. The tool storage device as claimed in claim 7, wherein said driving member has an annular wall that is formed with said slot, said return spring biasing said locking bolt along the axis to abut against an inner surface of said annular wall when said linkage unit is in the expanded position.

* * * * *